US008757326B2

(12) United States Patent
Hannemann et al.

(10) Patent No.: US 8,757,326 B2
(45) Date of Patent: Jun. 24, 2014

(54) PALLET STOPS FOR LIFT TRUCKS

(75) Inventors: Stefan Hannemann, Munich (DE); Leszek Galek, Ebersberg (DE)

(73) Assignee: Crown Equipment Corporaton, New Bremen, OH (US)

( * ) Notice: Subject to any disclaimer, the term of this patent is extended or adjusted under 35 U.S.C. 154(b) by 281 days.

(21) Appl. No.: 13/271,309

(22) Filed: Oct. 12, 2011

(65) Prior Publication Data

US 2013/0092477 A1 Apr. 18, 2013

(51) Int. Cl.
*B66F 9/06* (2006.01)
*B66C 3/00* (2006.01)

(52) U.S. Cl.
USPC ..... 187/222; 414/785

(58) Field of Classification Search
USPC ..... 187/222, 231, 237, 238; 414/607, 608, 414/629, 631, 785; 108/53.1, 57.12, 57.17
IPC ..... B66F 9/12,9/18
See application file for complete search history.

(56) References Cited

U.S. PATENT DOCUMENTS 2,420,625 A * 5/1947 Stalnaker et al. ..... 206/595
2,574,045 A * 11/1951 Lapham ..... 414/642
2,956,701 A 10/1960 Larson
3,052,323 A * 9/1962 Hopfeld ..... 187/232
3,262,537 A 7/1966 Wright
3,265,158 A 8/1966 Constable
3,638,761 A 2/1972 Ohta
4,050,599 A * 9/1977 Bender ..... 414/659
4,073,394 A 2/1978 Biaggini et al.
4,102,464 A 7/1978 Schuster
4,126,208 A * 11/1978 McVeen ..... 187/222
4,126,209 A * 11/1978 Higgins et al. ..... 187/222
4,286,913 A 9/1981 Rowe et al.
4,441,585 A 4/1984 Macnab
4,721,187 A 1/1988 Riddle
4,961,681 A 10/1990 Threatt (Continued)

FOREIGN PATENT DOCUMENTS

CH 676708 A5 2/1991
DE 1431709 5/1968

(Continued)

OTHER PUBLICATIONS

Ozsoy, Sevda; International Search Report and Written Opinion; International Application No. PCT/US2012/058916; Jan. 17, 2013; European Patent Office.

*Primary Examiner* — William E Dondero
*Assistant Examiner* — Minh Truong
(74) *Attorney, Agent, or Firm* — Stevens & Showalter LLP

(57) ABSTRACT

A lift truck includes a frame defining a main structural component of the lift truck, a mast assembly secured to the frame, first and second lower forks, first and second upper forks, and first and second pallet stops. The lower forks are secured to the frame and are provided for supporting a lower load carried by the lift truck. The upper forks are located above the lower forks and are provided for supporting an upper load carried by the lift truck. The upper forks are movable with respect to the lower forks along the mast assembly. The pallet stops position the lower load on the lower forks and are secured in place between the mast assembly and the frame at laterally spaced apart locations. Each pallet stops includes a surface for contacting the lower load and for maintaining the lower load at a desired axial position.

20 Claims, 4 Drawing Sheets

(56) References Cited

U.S. PATENT DOCUMENTS

| | | | | |
|---|---|---|---|---|
| 5,046,585 | A | 9/1991 | Ohta et al. | |
| 5,064,338 | A | 11/1991 | Lawrence | |
| 5,456,565 | A | 10/1995 | Pigott et al. | |
| 5,618,159 | A | 4/1997 | Wilson | |
| 5,788,452 | A * | 8/1998 | Brouwer et al. | 414/631 |
| 5,897,286 | A | 4/1999 | Whittaker | |
| 5,951,236 | A * | 9/1999 | Thompson | 414/607 |
| 6,199,665 | B1 * | 3/2001 | Eilerman et al. | 187/232 |
| 6,474,905 | B1 * | 11/2002 | Smith et al. | 404/35 |
| 6,766,882 | B2 | 7/2004 | Lohmann | |
| 6,902,039 | B2 | 6/2005 | Kunch | |
| 7,246,685 | B2 | 7/2007 | Tyree | |
| 7,681,742 | B2 | 3/2010 | Tyree | |
| 7,730,599 | B2 | 6/2010 | Tyree | |
| 7,744,335 | B1 | 6/2010 | Cleary | |
| 2007/0069017 | A1 | 3/2007 | Magens et al. | |
| 2008/0101907 | A1 | 5/2008 | Hedstrom et al. | |
| 2008/0142307 | A1 | 6/2008 | Rath | |
| 2009/0260924 | A1 | 10/2009 | Rice et al. | |
| 2011/0120807 | A1 * | 5/2011 | Persson et al. | 187/237 |
| 2011/0139546 | A1 | 6/2011 | Look | |
| 2011/0198157 | A1 * | 8/2011 | Sharp | 187/222 |

FOREIGN PATENT DOCUMENTS

| | | | | |
|---|---|---|---|---|
| DE | 3721547 | A1 | 1/1989 | |
| DE | 29514676 | U1 | 3/1997 | |
| DE | 19615592 | A1 | 10/1997 | |
| DE | 19741742 | A1 | 4/1999 | |
| DE | 19756473 | C1 | 6/1999 | |
| DE | 10258294 | A1 | 7/2004 | |
| DE | 10258295 | A1 | 7/2004 | |
| DE | 202006008368 | U1 | 9/2006 | |
| DE | 102009020947 | A1 | 11/2010 | |
| EP | 0449029 | A1 | 3/1991 | |
| EP | 1932799 | A1 | 12/2007 | |
| EP | 2159185 | A1 * | 3/2010 | B66F 9/12 |
| EP | 2251298 | A1 | 11/2010 | |
| GB | 2137161 | A | 10/1984 | |
| GB | 2250267 | A | 6/1992 | |
| JP | 8188396 | A | 7/1996 | |
| JP | 2000118985 | A | 4/2000 | |
| JP | 2007091423 | A | 4/2007 | |

* cited by examiner

FIG - 4
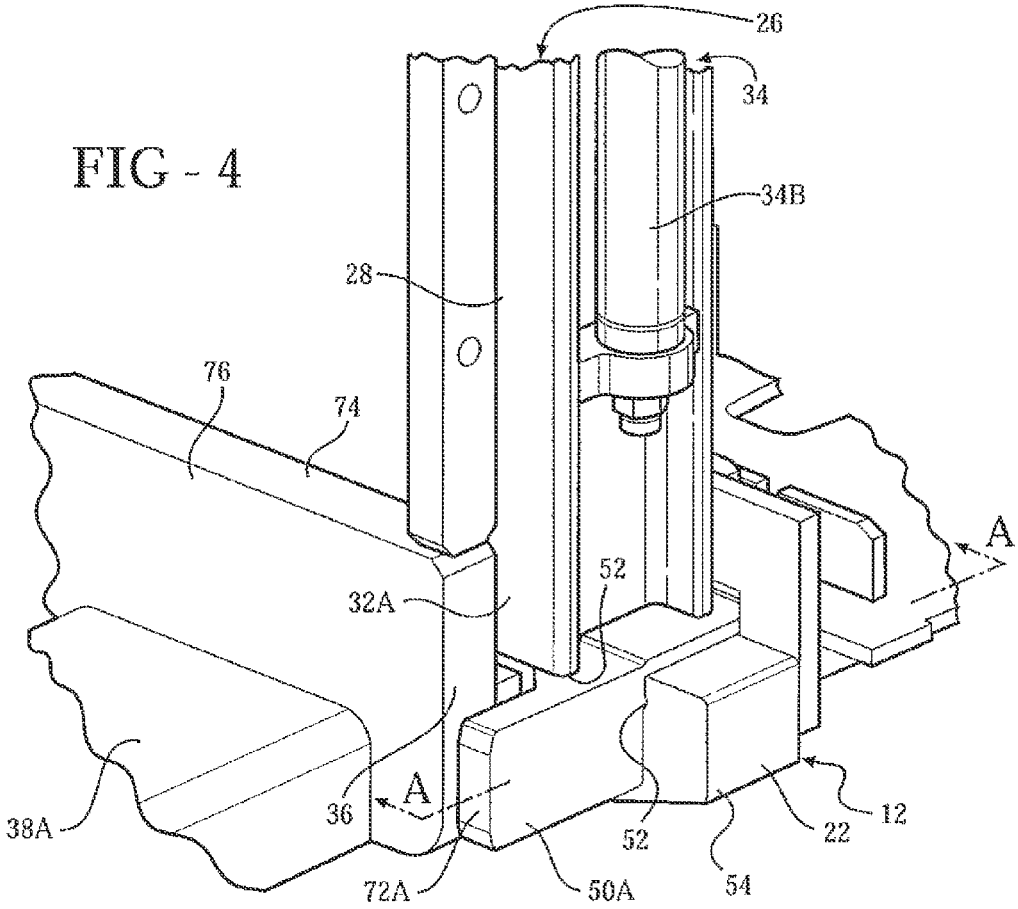
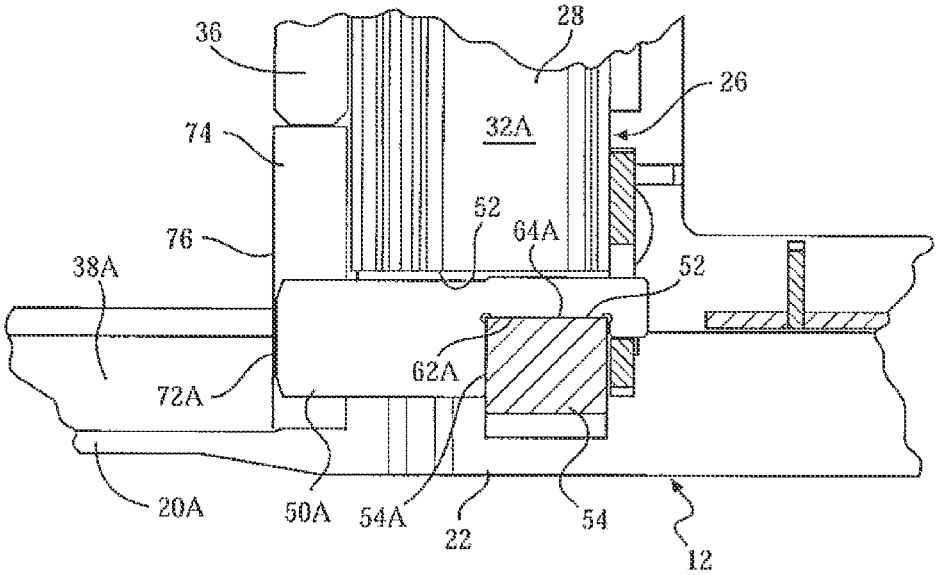
FIG - 5

PALLET STOPS FOR LIFT TRUCKS

FIELD OF THE INVENTION

The present invention relates to structures (pallet stops) that are used for positioning loads supported on lower forks of double stacker lift trucks.

BACKGROUND OF THE INVENTION

In warehouses and similar environments, lift trucks are typically used to pick up and deliver goods for further transport or processing. To increase the operating efficiency of materials handling, lift trucks have been developed with double loading capacity. Such lift trucks, generally referred to as "double stacker trucks" or merely as "double stackers", are provided with two pairs of forks, i.e., a lower pair of forks and an upper pair of forks that are movable with respect to the lower pair. In operation, a first pallet is loaded on the upper forks, which are then raised along a mast assembly. Thereafter, a second pallet is loaded on the lower forks such that the carrying capacity of the truck is increased, thus increasing materials handling efficiency.

BRIEF SUMMARY OF THE INVENTION

The present invention relates to pallet stops for lift trucks, wherein the pallet stops provide lateral orientation and axial positioning for loads supported on lower forks of the lift trucks.

In accordance with a first aspect of the present invention, a lift truck comprises a frame defining a main structural component of the lift truck, a mast assembly secured to the frame, first and second lower forks, first and second upper forks, and first and second pallet stops. The lower forks are secured to the frame and are provided for supporting a lower load carried by the lift truck. The upper forks are located above the lower forks and are provided for supporting an upper load carried by the lift truck. The upper forks are movable with respect to the lower forks along the mast assembly. The pallet stops are provided to position the lower load on the lower forks and are secured in place between the mast assembly and the frame at laterally spaced apart locations. Each pallet stops includes a surface for contacting the lower load carried on the lower forks and for maintaining the lower load at a desired axial position.

In accordance with a second aspect of the present invention, a lift truck comprises a frame defining a main structural component of the lift truck, a mast assembly, first and second lower forks, first and second upper forks, and first and second pallet stops. The mast assembly comprises a fixed mast section and a movable mast section. The fixed mast section includes first and second vertical support members secured to the frame. The movable mast section is coupled to the fixed mast section for vertical movement thereon. The lower forks are secured to the frame and are provided for supporting a lower load carried by the lift truck. The upper forks are located above the lower forks and are provided for supporting an upper load carried by the lift truck. The upper forks are movable with respect to the lower forks along the mast assembly. The pallet stops are removable from the lift truck and provide lateral orientation and axial positioning for the lower load on the lower forks. The first pallet stop is secured in place between the first vertical support member and the frame and the second pallet stop is secured in place between the second vertical support member and the frame. Each of the pallet stops includes a surface for contacting the lower load on the lower forks and for maintaining the lower load at a desired lateral orientation and axial position.

BRIEF DESCRIPTION OF THE SEVERAL VIEWS OF THE DRAWINGS

FIG. 4 is an enlarged perspective view illustrating one of the pallet stops of the lift truck illustrated in FIGS. 1-3; and FIG. 5 is a side cross sectional view illustrating the pallet stop shown in FIG. 4 taken along line A-A in FIG. 4.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
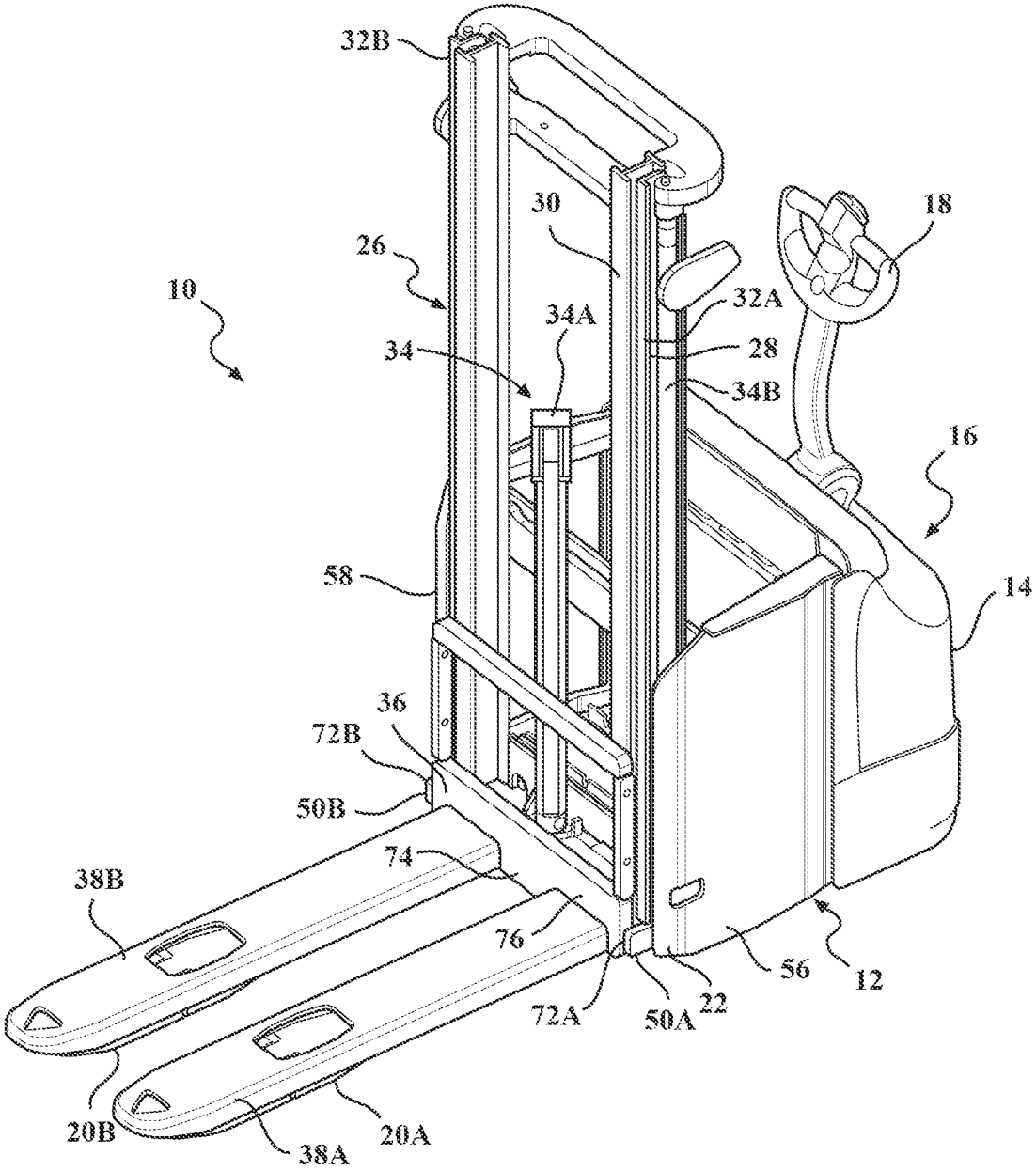
FIG. 1 is a perspective view of a lift truck including a pair of pallet stops according to an aspect of the present invention.
Figure 2:
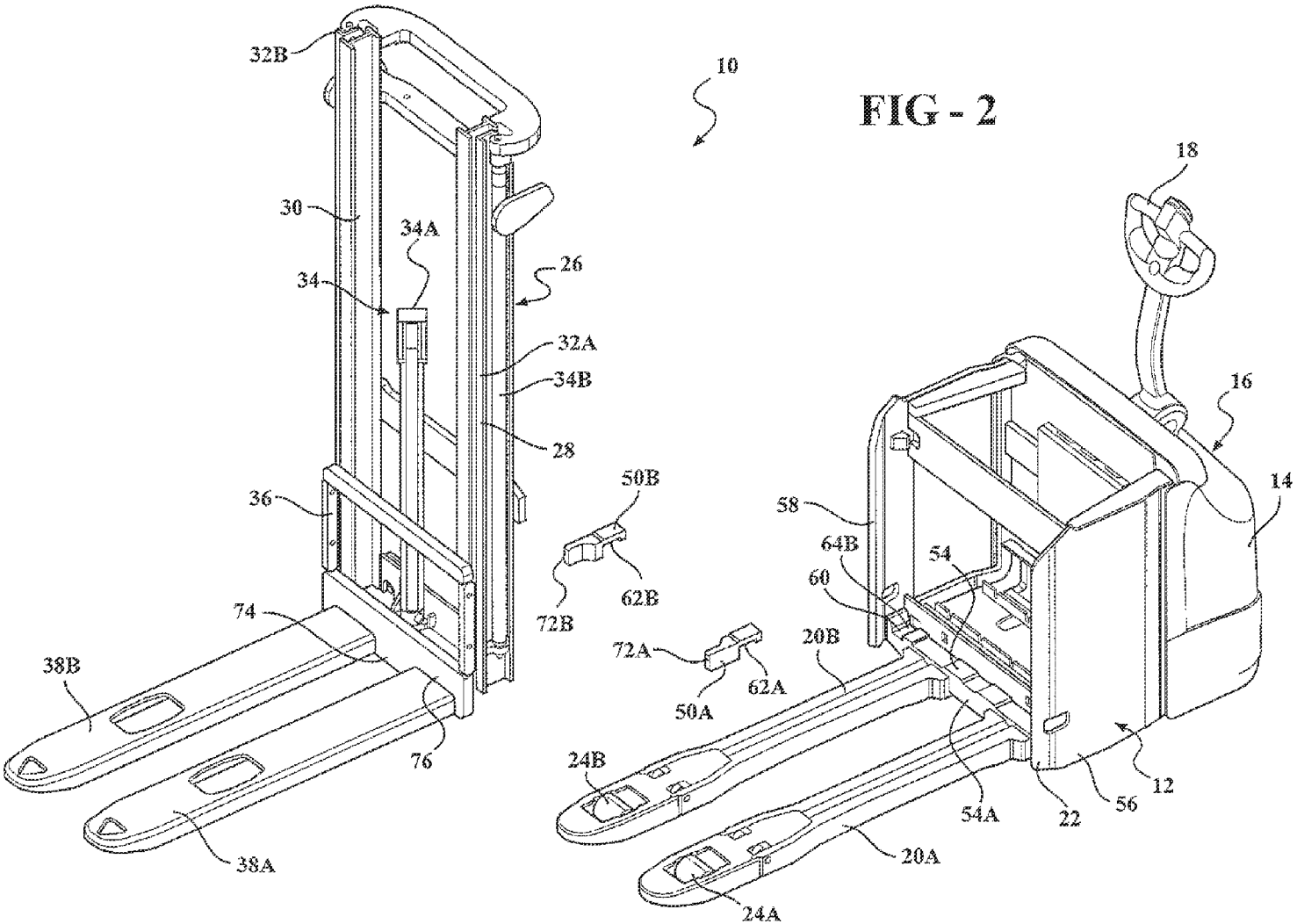
FIG. 2 is an exploded perspective view of the lift truck illustrated in FIG. 1.

FIGS. 1 and 2 illustrate a lift truck 10 according to an aspect of the present invention. The lift truck 10 comprises a frame 12 that defines a main structural component of the lift truck 10 and houses a battery (not shown) that is provided to power the lift truck 10. A first end 14 of the frame 12 comprises an operator's area 16 having conventional controls including a controller 18, which is used by an operator to control movement and operation of the lift truck 10.

First and second lower forks 20A, 20B extend generally horizontally from a second end 22 of the frame 12, the second end 22 being spaced in an axial direction from the first end 14. Specifically, the first and second lower forks 20A, 20B extend horizontally from a forward facing surface 54A of a lateral support bar 54 of the frame 12, as most clearly shown in FIG. 2. The lower forks 20A, 20B each include a load wheel 24A, 24B (see FIG. 2) and are provided for supporting a lower load LL (see FIG. 3) carried by the lift truck 10.

The lift truck 10 further comprises a mast assembly 26 secured to the frame 12. The mast assembly 26 includes a fixed mast section 28 and a movable mast section 30. The fixed mast section 28 comprises first and second vertical support members 32A, 32B that are secured to the frame 12. The movable mast section 30 is coupled to the fixed mast section 28 for vertical movement thereon, i.e., the movable mast section 30 moves vertically along the first and second vertical support members 32A, 32B.

The lift truck 10 also includes a lift system 34 comprising a primary lift cylinder 34A and a pair of secondary lift cylinders 34B (only one secondary lift cylinder is shown in FIGS. 1-4). The lift system 34 is provided for raising and lowering the movable mast section 30 and for raising and lowering a carriage assembly 36 and associated first and second upper forks 38A, 38B. The upper forks 38A, 38B are located above the lower forks 20A, 20B and extend generally horizontally from the carriage assembly 36 for supporting an upper load UL (see FIG. 3) carried by the lift truck 10. The movable mast section 30 and the carriage assembly 36 are raised and lowered by the lift system 34 in a known manner.

The lift truck 10 further comprises first and second pallet stops 50A, 50B that provide positioning for the lower load LL supported on the lower forks 20A, 20B, as will be described herein. Referring to FIGS. 4 and 5, the first pallet stop 50A is held in place in an opening 52 formed between respective surfaces of the mast assembly 26 and the second end 22 of the frame 12, i.e., the first pallet stop 50A is effectively clamped or otherwise secured in place in the opening 52 between the mast assembly 26 and the frame 12. More specifically, the first pallet stop 50A is held in place in the opening 52 between respective surfaces of the first vertical support member 32A of the fixed mast section 28 and the lateral support bar 54 of the frame 12, which support bar 54 extends laterally from a first side 56 of the frame 12 to a second side 58 of the frame, see FIG. 2.

The second pallet stop 50B is held in place in an opening 60 (see FIG. 2) formed between respective surfaces of the mast assembly 26 and the second end 22 of the frame 12, i.e., the second pallet stop 50B is effectively clamped or otherwise secured in place in the opening 60 between the mast assembly 26 and the frame 12. More specifically, the second pallet stop 50B is held in place in the opening 60 between respective surfaces of the second vertical support member 32B of the fixed mast section 28 and the lateral support bar 54 of the frame 12.

It is noted that, while the pallet stops 50A, 50B are disclosed as being secured in the openings 52, 60 between the mast assembly 26 and the frame 12, the pallet stops 50A, 50B are not affixed to the frame 12 or to the mast assembly 26 and can be removed from the lift truck 10 by removing the mast assembly 26 from the lift truck 10 and then by removing the pallet stops 50A, 50B. Hence, the pallet stops 50A, 50B are considered to be removable from the lift truck 10.

As shown most clearly in FIG. 1, the pallet stops 50A, 50B are located laterally inwardly from the respective sides 56, 58 of the frame 12. Further, as shown in FIGS. 4 and 5, the pallet stops 50A, 50B (only the first pallet stop 50A is shown in FIGS. 4 and 5) are located under the respective first and second vertical support members 32A, 32B of the fixed mast section 28 and extend over and engage the top of the support bar 54 of the frame 12. The pallet stops 50A, 50B in the embodiment illustrated include notches 62A, 62B that are received in corresponding grooves 64A, 64B formed in the lateral support bar 54. The notches 62A, 62B receive the lateral support bar 54 within the grooves 64A, 64B to secure the pallet stops 50A, 50B to the lateral support bar 54. The notches 62A, 62B are provided to prevent the pallet stops 50A, 50B from moving in the axial direction, and the grooves 64A, 64B are provided to prevent the pallet stops 50A, 50B from moving in the lateral direction.

Figure 3:
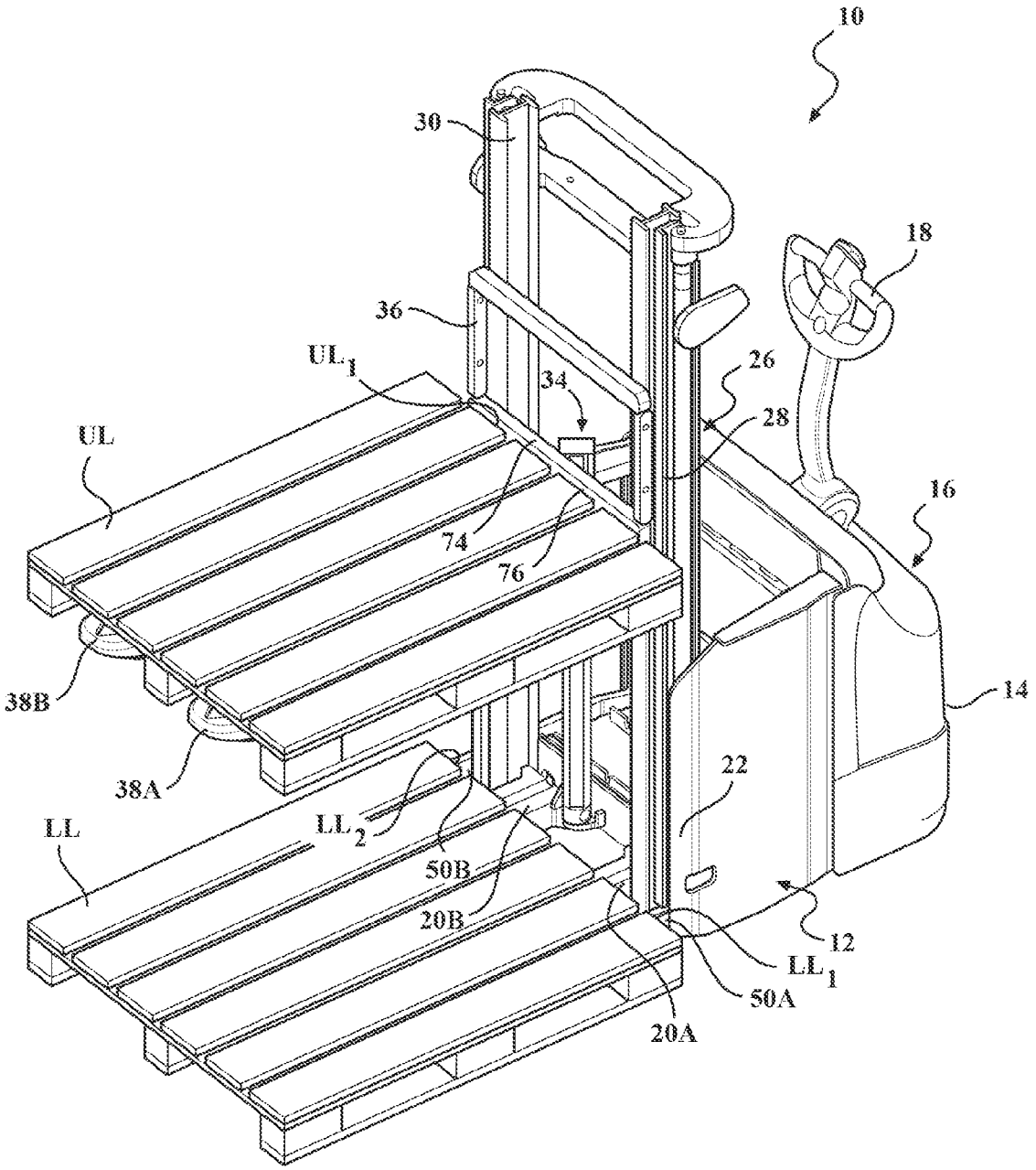
FIG. 3 is a perspective view of the lift truck of FIGS. 1 and 2 supporting first and second loads on respective lower and upper pairs of forks.

Each of the pallet stops 50A, 50B includes an axially forward surface 72A, 72B for contacting the lower load LL supported on the lower forks 20A, 20B and for squaring up the lower load LL laterally and maintaining the lower load LL at a desired axial position on the lower forks 20A, 20B. Preferably, the desired position is generally directly beneath the upper load UL supported on the upper forks 38A, 38B, as shown in FIG. 3. As shown in FIG. 5, the axially forward surfaces 72A, 72B of the first and second pallet stops 50A, 50B (only the first pallet stop 50A is shown in FIG. 5) extend axially (longitudinally) as least as far as (and preferably past) the forward facing surface 54A of the lateral support bar 54 so that the axially forward surfaces 72A, 72B of the first and second pallet stops 50A, 50B are able to contact first and second end surfaces $LL_1$, $LL_2$ of the lower load LL as will be discussed below. Upper surfaces of the pallet stops 50A, 50B may also provide vertical positioning for the first and second vertical support members 32A, 32B of the fixed mast section 28.

The upper forks 38A, 38B extend generally horizontally from a lateral fork support member 74 of the carriage assembly 36, see FIGS. 1 and 2. The lateral fork support member 74 includes axially facing contact surface 76 that squares up the upper load UL laterally and maintains the upper load UL in a desired axial position. As shown in FIG. 1, the pallet stops 50A, 50B are located laterally outwardly from the lateral fork support member 74, and the forward surfaces 72A, 72B of the pallet stops 50A, 50B are generally planar with the contact surface 76 of the lateral fork support member 74. Hence, the pallet stops 50A, 50B and the lateral fork support member 74 provide axial alignment of the respective upper and lower loads UL, LL generally directly above and below one another on the upper and lower forks 38A, 38B, 20A, 20B, thus creating a desired load distribution so as to provide increased stability of the upper and lower loads UL, LL on the lift truck 10.

During operation of the lift truck 10, while the upper forks 38A, 38B are in their lowered positions as shown in FIG. 1, the lift truck 10 is moved to a first pick location, at which point a first load, also referred to herein as the upper load UL, is loaded onto the upper forks 38A, 38B. As the upper load UL is loaded onto the upper forks 38A, 38B, a first end surface $UL_1$ of the upper load UL (see FIG. 3) contacts the contact surface 76 of the lateral fork support member 74 so as to provide a desired lateral orientation and axial position of the upper load UL on the upper forks 38A, 38B.

The lift truck 10 is then moved to a second pick location and the lift system 34 is used to raise the carriage assembly 36 and the upper forks 38A, 38B. It is noted that the lift system 34 could be used to raise the carriage assembly 36 and the upper forks 38A, 38B before arriving at the second pick location, and the lift system 34 could also be used to raise the movable mast section 30 if necessary. Once at the second pick location and once the carriage assembly 36 and the upper forks 38A, 38B are raised, a second load, also referred to herein as the lower load LL, is loaded onto the lower forks 20A, 20B. As the lower load LL is loaded onto the lower forks 20A, 20B, the first and second end surfaces $LL_1$, $LL_2$ of the lower load LL (see FIG. 3) contact the forward surfaces 72A, 72B of the respective pallet stops 50A, 50B so as to provide a desired lateral orientation and axial position of the lower load LL on the lower forks 20A, 20B, which is generally directly beneath the axial position of the upper load UL on the upper forks 38A, 38B, as discussed above.

The lower forks 20A, 20B are then slightly raised to lift the lower load LL from the ground and the lift truck 10 is moved to drop locations where the respective lower and upper loads LL, UL are deposited in a known manner.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A lift truck comprising:

a frame defining a main structural component of the lift truck;

a mast assembly comprising a fixed mast section and a movable mast section, the fixed mast section including first and second vertical support members secured to the frame, the movable mast section being coupled to the fixed mast section for vertical movement thereon;

first and second lower forks extending in an axial direction and secured to the frame for supporting a lower load carried by the lift truck;

first and second upper forks extending in the axial direction and located above the lower forks for supporting an upper load carried by the lift truck, the first and second upper forks being movable with respect to the lower forks along the mast assembly; and first and second pallet stops that provide lateral orientation and axial positioning for the lower load on the lower forks, the first pallet stop being secured in place between the first vertical support member and the frame and the second pallet stop being secured in place between the second vertical support member and the frame, wherein each of the pallet stops includes a surface for contacting the lower load on the lower forks and for maintaining the lower load at a desired lateral orientation and axial position, wherein the surfaces of the pallet stops for contacting the lower load extend axially at least as far as a forward facing surface from which the first and second lower forks extend, and wherein the pallet stops are removable from the lift truck.

2. The lift truck of claim 1, wherein the pallet stops are removably clamped in openings between the respective first and second vertical support members and the frame.

3. The lift truck of claim 1, wherein the pallet stops are located laterally inwardly from respective sides of the frame.

4. The lift truck of claim 3, wherein the pallet stops are located under the respective first and second vertical support members.

5. The lift truck of claim 4, wherein the pallet stops engage a lateral support bar of the frame from which the lower forks extend.

6. The lift truck of claim 5, wherein:

the pallet stops include notches that receive the lateral support bar to secure the pallet stops to the lateral support bar and to prevent the pallet stops from moving in the axial direction with respect to the frame; and the pallet stops are received in grooves formed in the lateral support bar to secure the pallet stops to the lateral support bar and to prevent the pallet stops from moving in the lateral direction with respect to the frame.

7. The lift truck of claim 1, wherein the pallet stops position the lower load on the lower forks generally directly beneath the upper load on the upper forks.

8. The lift truck of claim 1, wherein the pallet stops are located laterally outwardly from a carriage assembly coupled to the movable mast section, the upper forks extending from the carriage assembly.

9. The lift truck of claim 8, wherein the surface of each pallet stop that contacts the lower load on the lower forks is generally planar with a contact surface of the carriage assembly, the contact surface of the carriage assembly providing lateral orientation and axial positioning for the upper load on the upper forks.

10. A lift truck comprising:

a frame defining a main structural component of the lift truck;

a mast assembly secured to the frame;

first and second lower forks extending in an axial direction and secured to the frame for supporting a lower load carried by the lift truck;

first and second upper forks extending in the axial direction and located above the lower forks for supporting an upper load carried by the lift truck, the first and second upper forks being movable with respect to the lower forks along the mast assembly; and first and second pallet stops that position the lower load on the lower forks, the first and second pallet stops being secured in place between the mast assembly and the frame at laterally spaced apart locations, wherein each of the pallet stops includes a surface for contacting the lower load on the lower forks and for maintaining the lower load at a desired axial position, wherein the surfaces of the pallet stops for contacting the lower load extend axially at least as far as a forward facing surface from which the first and second lower forks extend.

11. The lift truck of claim 10, wherein the pallet stops are removable from the lift truck.

12. The lift truck of claim 10, wherein the pallet stops are clamped in respective openings between the mast assembly and the frame.

13. The lift truck of claim 12, wherein the pallet stops are located laterally inwardly from respective sides of the frame.

14. The lift truck of claim 13, wherein the pallet stops are located under respective vertical support members of the mast assembly.

15. The lift truck of claim 14, wherein the pallet stops engage a lateral support bar of the frame from which the lower forks extend.

16. The lift truck of claim 15, wherein the pallet stops include notches that receive the lateral support bar to secure the pallet stops to the lateral support bar and to prevent the pallet stops from moving in the axial direction with respect to the frame.

17. The lift truck of claim 16, wherein the pallet stops are received in grooves formed in the lateral support bar to secure the pallet stops to the lateral support bar and to prevent the pallet stops from moving in the lateral direction with respect to the frame.

18. The lift truck of claim 10, wherein the pallet stops position the lower load supported on the lower forks generally directly beneath the upper load supported on the upper forks.

19. The lift truck of claim 10, wherein the pallet stops are located laterally outwardly from a carriage assembly coupled to the mast assembly, the upper forks extending from the carriage assembly.

20. The lift truck of claim 19, wherein the surface of each pallet stop that contacts the lower load on the lower forks is generally planar with a contact surface of the carriage assembly, the contact surface of the carriage assembly providing lateral orientation and axial positioning for the upper load on the upper forks.

* * * * *